US010113360B2

(12) United States Patent
Hall et al.

(10) Patent No.: US 10,113,360 B2
(45) Date of Patent: Oct. 30, 2018

(54) ROLL-UP WALL TENSIONING

(71) Applicants: David R. Hall, Provo, UT (US); Andrew Priddis, Mapleton, UT (US); Jedediah Knight, Provo, UT (US)

(72) Inventors: David R. Hall, Provo, UT (US); Andrew Priddis, Mapleton, UT (US); Jedediah Knight, Provo, UT (US)

(73) Assignee: Hall Labs LLC, Provo, UT (US)

( * ) Notice: Subject to any disclaimer, the term of this patent is extended or adjusted under 35 U.S.C. 154(b) by 112 days.

(21) Appl. No.: 15/373,896

(22) Filed: Dec. 9, 2016

(65) Prior Publication Data

US 2018/0163466 A1 Jun. 14, 2018

(51) Int. Cl.

| | |
|---|---|
| ***E06B 9/72*** | (2006.01) |
| ***E06B 9/50*** | (2006.01) |
| ***E06B 9/80*** | (2006.01) |
| ***E06B 5/20*** | (2006.01) |
| *E06B 9/68* | (2006.01) |

(52) U.S. Cl.

CPC ..... *E06B 9/72* (2013.01); *E06B 5/20* (2013.01); *E06B 9/50* (2013.01); *E06B 9/80* (2013.01); *E06B 2009/6809* (2013.01); *E06B 2009/6818* (2013.01); *E06B 2009/801* (2013.01)

(58) Field of Classification Search

CPC ..... E06B 9/72; E06B 5/20; E06B 9/50; E06B 9/80; E06B 9/06; E06B 9/15; E06B 9/17046; E04B 1/82; E04B 1/84; E04B 2/721; E04B 2/88

See application file for complete search history.

(56) References Cited

U.S. PATENT DOCUMENTS

| | | | | |
|---|---|---|---|---|
| 8,659,246 | B2 * | 2/2014 | Mullet | E06B 9/40 160/133 |
| 9,963,873 | B2 * | 5/2018 | Hall | E04B 1/82 |
| 2010/0219183 | A1 * | 9/2010 | Azancot | H01F 38/14 219/676 |
| 2017/0074622 | A1 * | 3/2017 | Wallace | F41H 13/0018 |
| 2017/0275945 | A1 * | 9/2017 | Hall | E06B 9/72 |
| 2017/0275946 | A1 * | 9/2017 | Hall | E06B 9/72 |
| 2018/0030781 | A1 * | 2/2018 | Hall | E06B 9/386 |
| 2018/0087269 | A1 * | 3/2018 | Hall | E04B 2/7403 |

* cited by examiner

*Primary Examiner* — Beth A Stephan

(57) ABSTRACT

Various embodiments of a flexible, roll-up wall are described herein. The wall includes a roller drum having a selectively engageable one-way bearing, one or more power supplies, a motor, a flexible, sound-attenuating sheet, an electromagnet and at least one of a corresponding permanent magnet or ferromagnet, one or more conductive threads, a force meter, and a potentiometer. The motor is coupled to the drum by a transmission. The flexible sheet includes a base fabric and a polymer coating surrounding the base fabric, and is coupled to the roller drum at a first end of the sheet. The one or more conductive threads are woven into the base fabric. At least one conductive thread electrically couples the electromagnet to one of the power supplies. The potentiometer varies the current delivered to the electromagnet based on a force measured by the force meter.

20 Claims, 9 Drawing Sheets

ROLL-UP WALL TENSIONING

TECHNICAL FIELD

This invention relates generally to the field of modular interiors for buildings, and more specifically to modular walls.

BACKGROUND

Construction of buildings and furnishings has, in recent years, begun pivoting towards increased modularity. Such has been especially prevalent for furnishings, where designers and engineers have produced everything from couch-bunk bed hybrids to coffee tables that become desks. While significant advances have been made in the modularity of furnishings, modularity in building structures has presented significant engineering barriers that have yet to be solved. One such barrier is related to the size of a room. Many rooms in a home or office building are, for significant periods of time throughout a 24-hour period, unused, primarily because the activities engaged in by individuals that might otherwise use the room cannot be hosted in the room. For example, while a small 10'×10' room may suffice as an office, it would be much too small to host a large dinner party.

Some solutions to fixed room sizes have been presented, but such solutions are generally only useful in warehouse settings where one expects little more than a plastic sheet to segregate an area. Solutions have yet to be presented for true room-size modularity. Thus, there is still significant room for improvement at least in the area of room size modularity.

SUMMARY OF THE INVENTION

A flexible, roll-up wall is described herein that addresses some of the issues described above regarding previous solutions. In general, the roll-up wall includes a sound-attenuating sheet and a tensioning mechanism. The roll-up wall described herein offers several benefits. First, the wall is modular, offering room size modularity within a structure. Second, the tensioning mechanism pulls the wall taught, giving it a look and feel like a typical rigid room wall. Thus, the wall combines modularity with privacy features and aesthetics that convey to a user the sense of a true, rather than modular, wall.

Various embodiments of a flexible, roll-up wall are described herein. The wall includes a roller drum having a selectively engageable one-way bearing, one or more power supplies, a motor, a flexible, sound-attenuating sheet, an electromagnet and at least one of a corresponding permanent magnet or ferromagnet, one or more conductive threads, a force meter, and a potentiometer. The motor is coupled to the drum by a transmission, and is electrically coupled to at least one of the one or more power supplies. The flexible sheet includes a base fabric and a polymer coating surrounding the base fabric, and is coupled to the roller drum at a first end of the sheet. The one or more conductive threads are woven into the base fabric and extend from the first end of the flexible sheet to the second end of the flexible sheet. At least one of the one or more conductive threads is electrically coupled to the electromagnet and at least one of the one or more power supplies. The potentiometer is electrically coupled between the at least one power source coupled to the electromagnet and the electromagnet, wherein the potentiometer varies the current delivered to the electromagnet based on a force measured by the force meter.

BRIEF DESCRIPTION OF THE DRAWINGS

A more particular description of the system briefly described above is made below by reference to specific embodiments. Several embodiments are depicted in drawings included with this application, in which.

DETAILED DESCRIPTION

Figure 1:
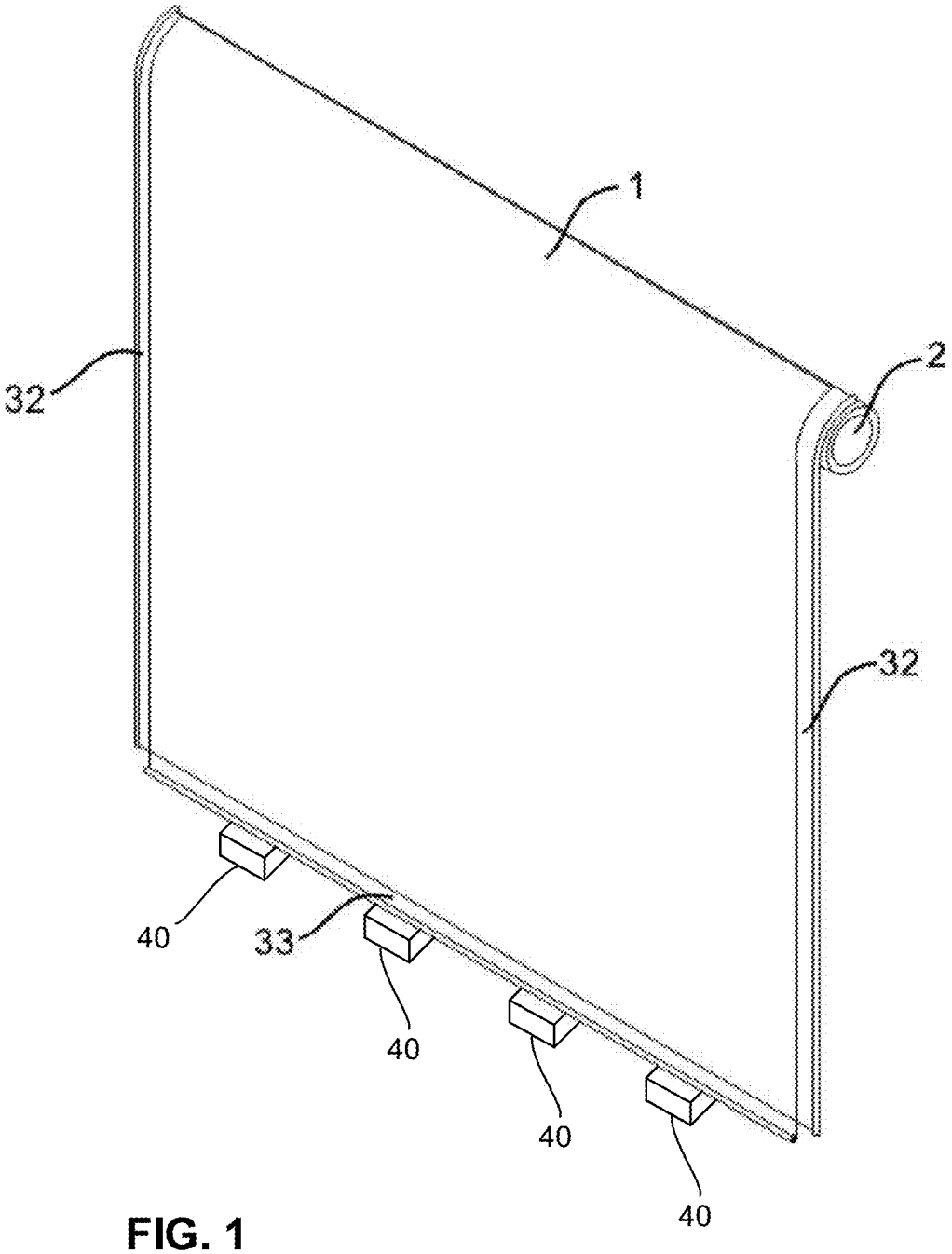
FIG. 1 depicts an isometric view of one embodiment of a flexible, roll-up wall.

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

The descriptions of the various embodiments include, in some cases, references to elements described regarding other embodiments. Such references are provided for convenience to the reader, and to provide efficient description and enablement of each embodiment, and are not intended to limit the elements incorporated from other embodiments to only the features described regarding the other embodiments. Rather, each embodiment is distinct from each other embodiment. Despite this, the described embodiments do not form an exhaustive list of all potential embodiments of the claimed invention; various combinations of the described embodiments are also envisioned, and are inherent from the descriptions of the embodiments below. Additionally, embodiments not described below that meet the limitations of the claimed invention are also envisioned, as is recognized by those of skill in the art.

Throughout the detailed description, various elements are described as "off-the-shelf." As used herein, "off-the-shelf" means "pre-manufactured" and/or "pre-assembled."

In some instances, features represented by numerical values, such as dimensions, quantities, and other properties that can be represented numerically, are stated as approximations. Unless otherwise stated, an approximate value means "correct to within 50% of the stated value." Thus, a length of approximately 1 inch should be read "1 inch+/−0.5 inch." Similarly, other values not presented as approximations have tolerances around the stated values understood by those skilled in the art. For example, a range of 1-10 should be read "1 to 10 with standard tolerances below 1 and above 10 known and/or understood in the art."

Described below are various embodiments of a modularized wall that enables variable room sizing in a rigid building, where the rooms convey a look and feel of typical, rigid room walls. The flexible, roll-up wall includes a roller drum having a selectively engageable one-way bearing, one or more power supplies, a motor, a flexible, sound-attenuating sheet, an electromagnet and at least one of a corresponding permanent magnet or ferromagnet, one or more conductive threads, a force meter, and a potentiometer. The motor is coupled to the drum by a transmission, and is electrically coupled to at least one of the one or more power supplies. The flexible sheet includes a base fabric and a polymer coating surrounding the base fabric, and is coupled to the roller drum at a first end of the sheet. The one or more conductive threads are woven into the base fabric and extend from the first end of the flexible sheet to the second end of the flexible sheet. At least one of the one or more conductive threads is electrically coupled to the electromagnet and at least one of the one or more power supplies. The potentiometer is electrically coupled between the at least one power source coupled to the electromagnet and the electromagnet, wherein the potentiometer varies the current delivered to the electromagnet based on a force measured by the force meter.

The roll-up wall is modular because it is easily and conveniently rolled up, instantly expanding a room size. In some embodiments, the roll-up wall is permanently affixed to the building, such as above a ceiling, and the flexible sheet extends down through the ceiling to the floor. However, in other embodiments, the roll-up wall is removably affixed to the building, and, in various embodiments, is transferred around and even out of the building. Such embodiments are considered to have thoroughly robust room size modularity.

The roll-up wall imitates a typical fixed, rigid wall through effective tensioning and sound attenuation. Rigidity of the wall is achieved using the magnets, force meter, potentiometer, and one-way bearing to create tension in the wall that resists deflection. In some embodiments, the rigidity is such that a 300-lb person leaning against the wall would not sense the wall has flexed.

Various embodiments of the wall include any of a variety of force meters. In some embodiments, the force meter includes a dynamometer. In other embodiments, the force meter includes a load cell. In yet other embodiments, the force meter includes a piezoelectric sensor. Additionally, various embodiments of the wall include the force meter being disposed in various positions with respect to the wall. For example, in some embodiments, the force meter is coupled to the motor, such as in some embodiments including the dynamometer. In some embodiments, the force meter is fixedly coupled to the electromagnet, the at least one corresponding permanent magnet or ferromagnet, or both. Additionally, in various embodiments, the force meter is fixedly coupled to the flexible sheet or an area of surface beneath the flexible sheet. Generally, however, the force meter is coupled, at one end, to a fixed object, and at the opposite end, to an object fixedly coupled to the flexible sheet, thereby allowing the force meter to measure the tension in the flexible sheet.

The general arrangement of the magnets allows the flexible sheet to be fixed to a surface such as a floor of a room. For example, in some embodiments, the electromagnet is coupled to the flexible sheet at a second end of the flexible sheet opposite the first end of the flexible sheet (the first end being coupled to the drum and the second end extending towards the floor), and the corresponding permanent and/or ferromagnet is disposed in the surface beneath the bottom edge along the second end of the flexible sheet. In other embodiments, the permanent and/or ferromagnet is fixedly coupled to the flexible sheet at the second end, and the electromagnet is disposed in the floor beneath the bottom edge of the second end of the flexible sheet.

Various embodiments of the roll-up wall also include a means for determining when to stop unrolling the flexible sheet from the drum. For example, in some embodiments, the sheet has a height equal to, or only slightly larger than, a known height of a ceiling in an area where the wall is being used. In such embodiments, the sheet is unrolled from the drum completely, and a simple position encoder determines when the sheet has been fully extended. However, in other embodiments, the roll-up wall is used in a variety of rooms having a variety of heights. In some such embodiments, a second permanent magnet is vertically coupled to one or more springs at the second end of the flexible sheet. A corresponding conductive coil is disposed in the floor beneath the bottom edge of the flexible sheet, and is aligned with the second magnet such that vertical oscillation of the second magnet incudes a current in the coil. The current is then carried by, for example, at least one of the conductive threads, to a controller that stops the motor from unrolling the sheet. In some embodiments, the second magnet extends beneath the bottom edge and, as the bottom edge contacts the floor, the second magnet extends into the coil. The sudden stop of the downward motion of the permanent magnet stretches the spring, causing the magnet to oscillate vertically and induce a current in the coil. The controller stores a threshold current and compares the current received from the col to the threshold current to determine whether the sheet has reached the floor.

In many embodiments, the roll-up wall includes a dedicated controller coupled to one or more of the motor, the power supplies, the electromagnet, the force meter, and the potentiometer. The controller includes one or more hardware processors and hardware memory. The hardware memory has instructions stored thereon for operating one or more of the motor, the power supplies, the electromagnet, the force meter, and the potentiometer. For example, in some embodiments, the instructions include detecting an increase in a force exerted on the flexible sheet and increasing an amount of current being delivered to the electromagnet. The increase in the current is proportional to, and based upon, the force exerted on the flexible sheet. In some embodiments, the instructions include unrolling the flexible sheet from the drum, detecting a bottom edge of the flexible sheet at the second end has reached a surface beneath the flexible sheet, engaging the one-way bearing with the roller drum, activating the electromagnet, and tensioning the flexible sheet. Some embodiments have instructions that include measuring an amount of tension in the flexible sheet, comparing the measured tension in the sheet to a desired tension, and shutting off the motor as the measured tension matches the desired tension. Additionally, in some embodiments, the memory stores data regarding an amount of tension required to tear the flexible sheet. In some such embodiments, instructions stored on the memory include determining, based on the data, an amount of current to deliver to the electromagnet such that a magnetic force exerted between the electromagnet and the at least one corresponding permanent magnet or ferromagnet is less than the amount of force required to tear the flexible sheet by an amount ranging from one one-hundredth of a percent to ten percent.

The roll-up wall panel system described herein is similar to those described in U.S. patent application Ser. No. 15/277,169 by David R. Hall et al for a "Flexible, Sound-Attenuating Roll-Up Wall System," incorporated herein by reference in its entirety, and U.S. patent application Ser. No. 15/278,679 by David R. Hall et al for a "Roll-up Wall," which is also incorporated herein by reference in its entirety.

FIG. 1 depicts an isometric view of one embodiment of a flexible, roll-up wall. The roll-up wall includes sound-attenuating panel 1, roller drum 2, a first and a second flexible, sound-attenuating guide 32, and a flexible, lower sound-attenuating seal 33. The first flexible, sound-attenuating guide 32 is disposed vertically along the first vertical side of the sound-attenuating panel 1 and the second flexible, sound-attenuating guide 32 is disposed vertically along the second vertical side of the sound-attenuating panel 1. The sound-attenuating lower seal 33 is disposed horizontally along the lower side of the sound-attenuating panel 1. In various embodiments, the lower seal includes a ferromagnet, such as an iron bar, wrapped in a nylon. Several electromagnets 40 are installed in the floor beneath the panel along the length of the bar.

Figure 2:
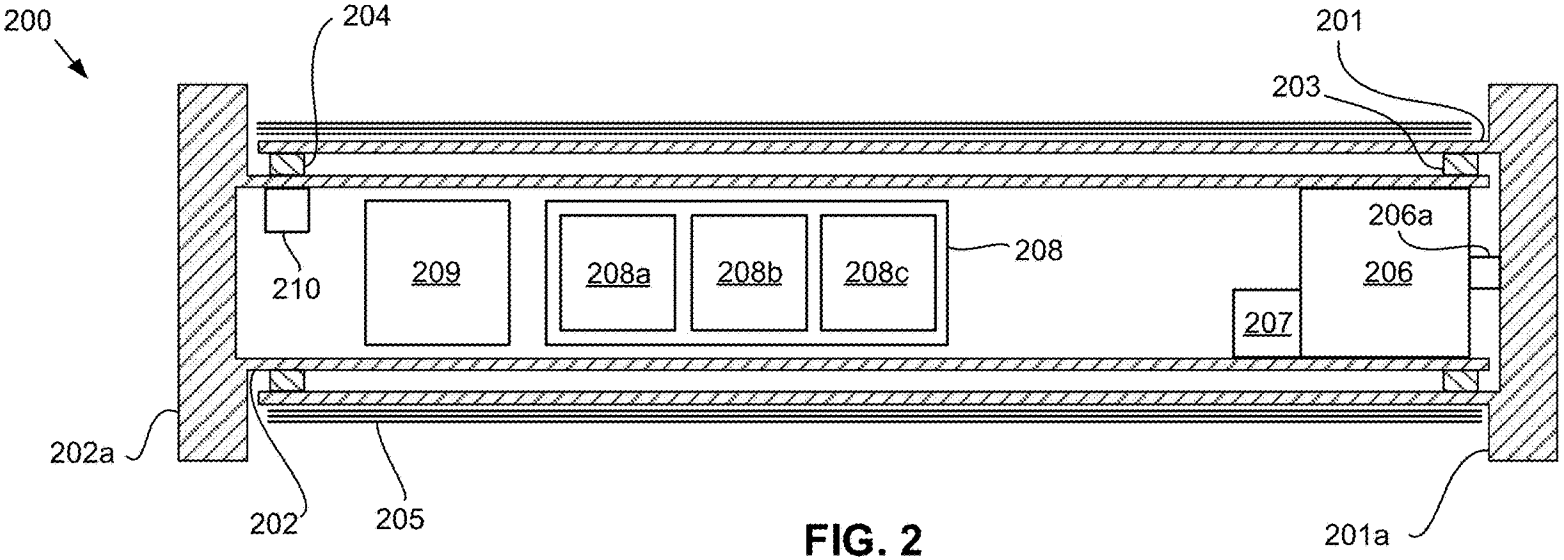
FIG. 2 depicts a section view of a roller drum, with selected components disposed within the drum.

FIG. 2 depicts a section view of a roller drum, with selected components disposed within the drum. Drum 200 includes outer drum 201, inner drum 202, bearing 203, and one-way bearing 204. Flexible, sound-attenuating sheet 205 is disposed around the outside drum. Inside the drum is motor 206, force meter 207, controller 208, power supply 209, and solenoid 210. The motor is fixed to the inner drum and rotates the outer drum by transmission 206*a*. Additionally, in some alternative embodiments, the force meter is disposed outside the outer drum between the flexible sheet and the outer drum.

The inner drum is fixedly coupled to a mounting surface by flange 202*a*, and the outer drum is rotatably coupled to a mounting surface by flange 201*a*. The outer drum flange includes one or more electrical contacts and wiring that conducts power and data from components inside the drum to conductive thread disposed in the flexible sheet. In some embodiments, the contacts include circular metal sheets disposed around the transmission coupled to wiring passing through the outer drum flange. Power and data lines are wired around the motor and transmission, and remain stationary relative to the inner drum as the outer drum rotates.

Because the inner drum is fixed, the motor can apply a torque to the outer drum. The bearings provide structural support for the outer drum while allowing the outer drum to rotate. The one-way bearing is selectively engageable by the solenoid, which extends through the inner drum into the one-way bearing to lock a non-rotating portion of the one-way bearing to the inner drum. The one-way bearing is described in more detail below regarding FIG. 3. Generally, when engaged, the one-way bearing locks the outer drum to the inner drum to prevent rotation of the outer drum in the "unrolling" direction. Additionally, the one-way bearing is not disposed between the outer and inner drums in every embodiment. In some embodiments, the one-way bearing is coupled to the outer drum flange and the solenoid is coupled to the mounting surface.

The motor is, ins some embodiments, any of a variety of off-the-shelf motors, such as a DC motor, an AC motor, a brushless motor, and others. In general, however, the motor is powerful enough to apply a torque to the outer drum strong enough to create a tension in the sheet as the sheet is fixed to the floor that imitates the rigidity of a typical fixed wall. In some embodiments, the motor includes an impact transmission, such as is described in U.S. patent application Ser. No. 15/241,589 filed on Aug. 19, 2016 by David R. Hall, et al, for a "Winch with Impact Transmission," which is incorporated herein by reference in its entirety.

The force meter is any of a variety of off-the-shelf force meters. In some embodiments, such as those where the force meter is disposed between the flexible sheet and the outer drum, the force meter directly measures the tension in the flexible sheet by compression of the force meter between the flexible sheet and outer drum as the outer drum pulls on, and tensions, the flexible sheet. In such embodiments, the force meter includes, for example, one or more load cells and/or piezoelectric sensors. However, in some embodiments, the force meter indirectly measures the tension in the flexible sheet by measuring the power output of the motor. In some embodiments, this is accomplished by measuring the current drawn by the motor using the controller. In other embodiments, this is accomplished using a dynamometer coupled directly to the motor. In general, the force meter is electrically coupled to the controller, and the controller has stored instructions for interpreting the signals generated by the force meter. In various embodiments, those instructions include performing the necessary calculations to convert the force measured by the force meter to the tension in the flexible sheet, and vice-versa. Additionally, in various embodiments, the controller has stored instructions and information for differentiating between the force exerted by the weight of the flexible sheet and a force exerted by tension in the sheet as the sheet is fixed to the floor. In some embodiments, this includes storing a threshold force correlating to the free-hanging weight of the flexible sheet, and in some embodiments, this includes storing a threshold force correlating to a minimum desirable tension in the sheet.

The controller generally includes hardware memory 208*a* and one or more hardware processors 208*b*. The hardware memory is, in many embodiments, non-volatile, and stores instructions for operating the roll-up wall and associated components. The processors include, in various embodiments, volatile and/or non-volatile memory, and execute the instructions stored in the hardware memory. Examples of some such instructions are described below regarding FIGS. 8-11.

Various embodiments of the controller, such as that depicted, also include potentiometer 208*c*. The potentiometer regulates current flowing to an electromagnet (described below in more detail regarding FIGS. 4-5) based, at least in part, on the force measured by the force meter. This provides the benefit of, among other benefits, conserving energy by only delivering the minimum power required to fix the sheet to the floor based on the tension in the sheet. As the tension in the sheet increases, such as when a person leans against the sheet, the motor rolls back on the sheet, and the current to the electromagnet increases proportionally. In some embodiments, electrical signals generated by the force meter are conveyed directly to the potentiometer, without the intervention of the general controller. Thus, in some such embodiments, the potentiometer is disposed separately from the controller, and itself acts as a controller for the electromagnet.

The power supply includes any of a variety of off-the-shelf power supplies, including, among others, batteries, power transformers, and/or rectifiers. For example, in some embodiments, the roll-up wall is battery-powered, such as in embodiments where the roll-up wall is removably fixed to the building, and is transported to other portions of the building based on modular room needs. In other embodiments, the roll-up wall is permanently fixed to the building, and is powered by, for example, mains electricity. In some such embodiments, the power supply is a transformer that steps the voltage of the mains electricity up or down based on the needs of the roll-up wall electrical components. Thus, in some embodiments, several transformers are included. In mains electricity embodiments also including a DC motor, the power supply also includes a rectifier. Alternatively, in some embodiments the rectifier is built into the motor. The electromagnet that fixes the flexible sheet, is, in various embodiments, powered by a stable DC source, such as a battery, regardless of the power source used for the motor and roller drum electrical components. This ensures constant, unwavering tension in the flexible sheet.

Figure 3:
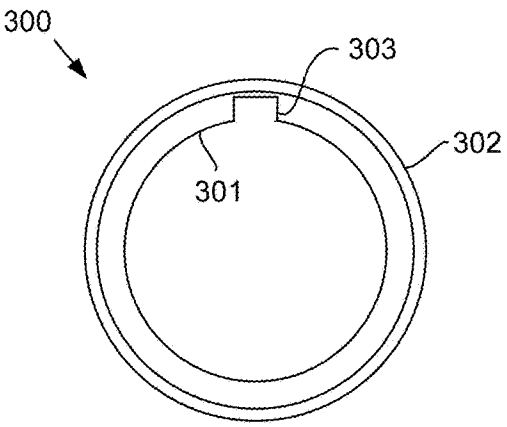
FIG. 3 depicts one embodiment of a one-way bearing.

FIG. 3 depicts one embodiment of a one-way bearing. Bearing 300 includes inner ring 301, outer ring 302, and notch 303. Though only one notch is depicted, various embodiments include additional notches. Including additional notches reduces the amount the bearing must rotate to align with a fixing member, such as the solenoid described above. The inner ring is rotatable in two directions, whereas the outer ring is only rotatable in a direction that winds up a flexible panel onto a drum (each similar to those described above regarding FIG. 2). The notch allows the fixing member to prevent rotation of the bearing relative to an inner drum, thereby only allowing rotation of an outer drum in one direction. This effectively serves as a brake for the drum.

Figure 4:
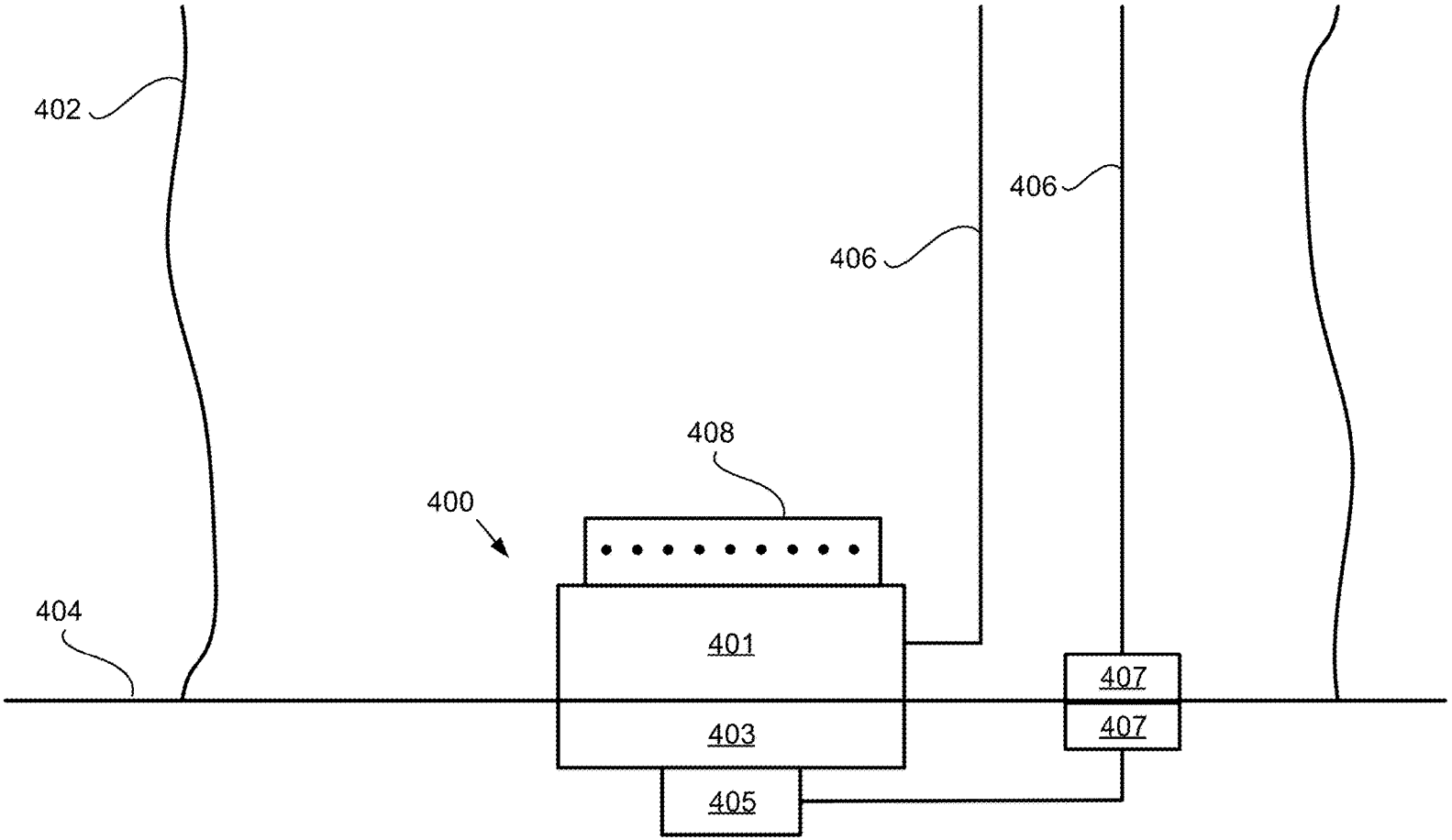
FIG. 4 depicts a side view of a tensioning mechanism for a roll-up wall.

FIG. 4 depicts a side view of a tensioning mechanism for a roll-up wall. Tensioning mechanism 400 includes, at least, electromagnet 401 affixed to flexible sheet 402 and magnetic bar 403 disposed in floor 404. Additionally, depicted is force meter 405, conductive threads 406, electrical contacts 407, and electromagnet mounting panel 408. Though in the depicted embodiment the electromagnet is coupled to the flexible sheet and the magnetic bar is fixed to the floor, various embodiments also include the reverse arrangement. The conductive threads are provided in the flexible sheet to communicate power and data with the electromagnet and/or force meter without having to run power lines through the floor. This simplifies the process of building a structure having modular rooms.

The electromagnet is any of a variety of electromagnets, but generally includes those structures commonly used for lifting and/or locking electromagnets. Enough coils, and wire of a sufficient gauge, are provided in the electromagnet to provide sufficient force to oppose the tension in the flexible sheet. The maximum tension in the flexible sheet is described in more detail below regarding FIG. 6. The electromagnet is powered, in the depicted embodiment, via the conductive thread, which is woven through and across the flexible sheet, by a DC power source. In some embodiments, the electromagnet includes its own battery, such as in embodiments where the electromagnet is installed in the floor. The electromagnet is fixed to the flexible sheet by the mounting panel, which includes channels and bolts that pass through the channels and the flexible sheet. Additionally, in various embodiments, including the depicted embodiment, the electromagnet is disposed in a cutout in the flexible sheet such that the flexible sheet wraps around the electromagnet and is flush with the floor.

The magnetic bar is comprised of any of a variety of magnetic materials, including permanent magnetic ceramics and/or ferromagnetic metals such as iron. The ferromagnetic bars have the benefit of being generally inert (besides possibly being prone to rust), whereas the permanent magnetic bars provide the additional benefit of securing the flexible sheet to the floor, without running a current to the electromagnet, for minimal levels of tension in the sheet. The floor includes, in various embodiments, a recess to accommodate the force meter and/or the magnetic bar. The magnetic bar is, in the depicted embodiment, fixed to the floor by the force meter. For example, in some embodiments, the force meter is welded to the ferromagnetic bar and bolted to the floor. However, in other embodiments, the force meter is bolted directly to the floor.

Figure 5:
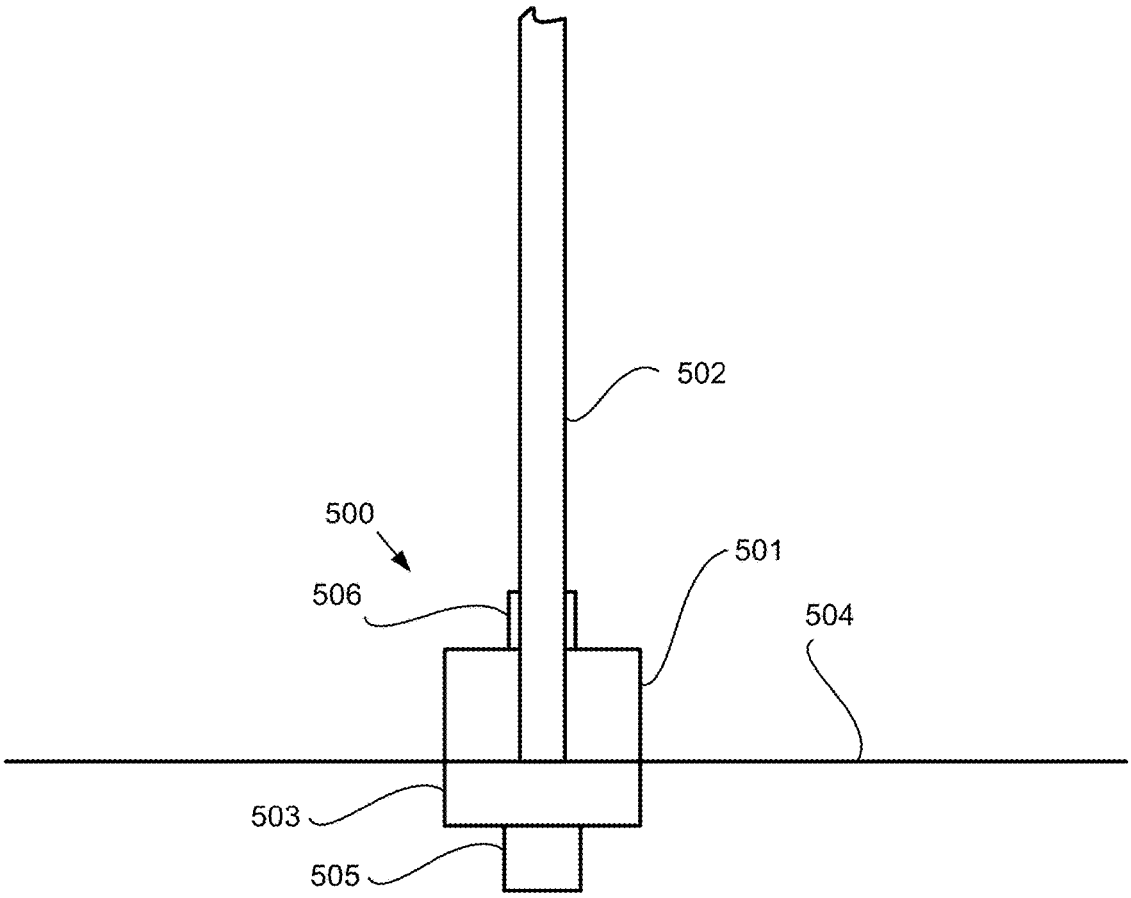
FIG. 5 depicts a side view of a tensioning mechanism, the view of FIG. 5 being perpendicular to the view depicted in FIG. 4.

FIG. 5 depicts a side view of a tensioning mechanism, the view of FIG. 5 being perpendicular to the view depicted in FIG. 4. Tensioning mechanism 500 includes electromagnet 501 affixed to flexible sheet 502, magnetic bar 503 disposed in floor 504, force meter 505, and mounting panels 506. As shown, the flexible sheet wraps around the electromagnet and is flush with the floor. However, in some embodiments, such as those where the electromagnet is disposed in the floor (like that depicted in FIG. 1), the flexible sheet extends into a slot in the floor, which, in various embodiments, increases the sound-attenuating properties of the wall.

Figure 6:
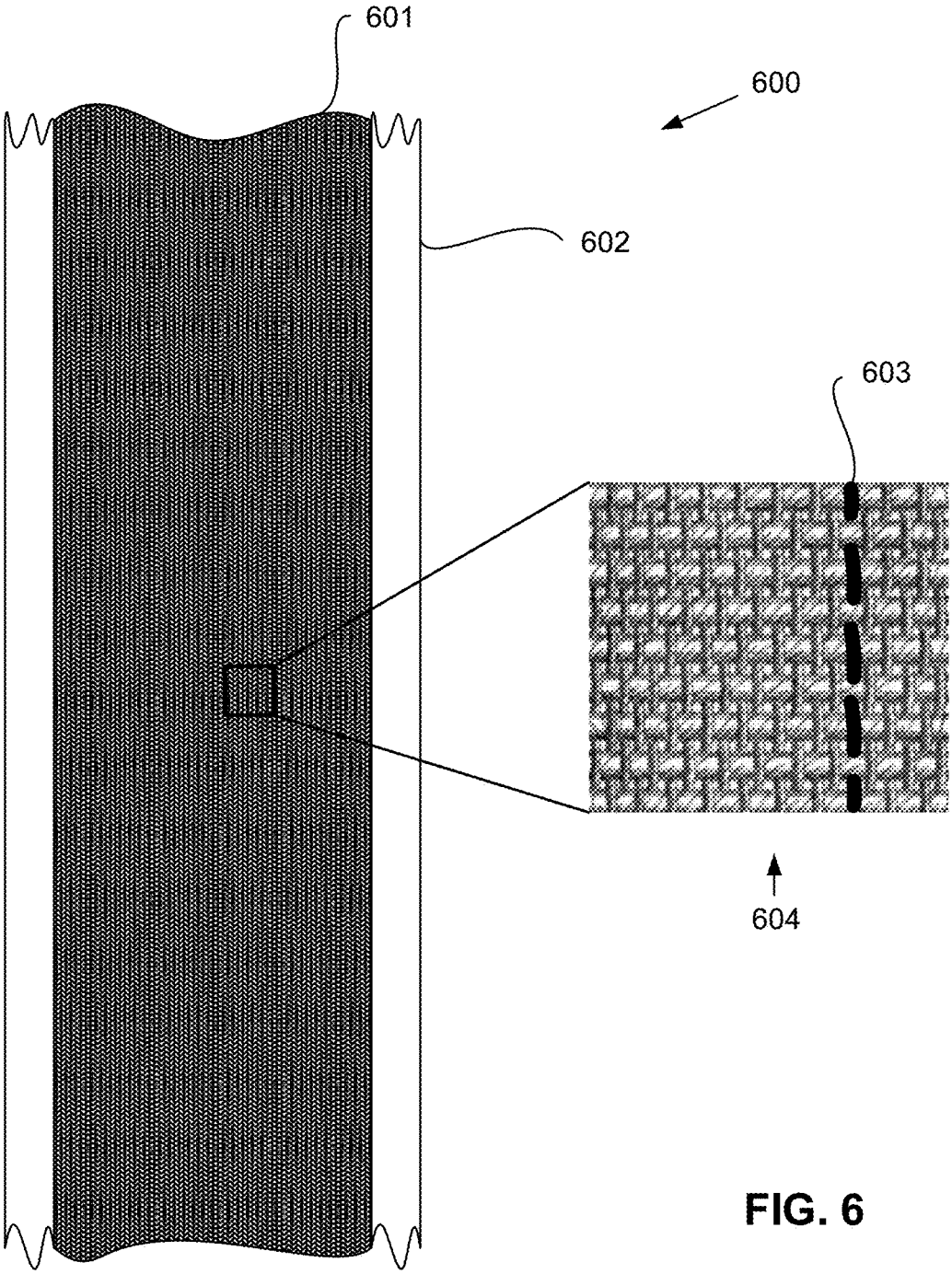
FIG. 6 depicts a section view of a portion of a flexible sheet for use with a roll-up wall.

FIG. 6 depicts a section view of a portion of a flexible sheet for use with a roll-up wall. Flexible sheet 600 includes base fabric 601, polymer coating 602, and conductive thread 603. As shown in blown-up cutout 604, the base fabric is woven, and the conductive thread is woven into the base fabric. In some example embodiments, the flexible sheet is a mass-loaded vinyl comprising a polyester base fabric and PVC coating.

Sound-attenuation is a significant feature of the flexible sheet. In many cases, the flexible sheet is the only material separating one room from another in a modularized building interior. The greater the sound-attenuation, the greater the sense of privacy an occupant in a modular room feels. This can be especially important in housing structures where, for example, the flexible sheet separates a living room from a bedroom or bathroom. Thus, in various embodiments, the flexible sheet generally has an STC rating ranging from 20 to 40.

Tensile strength and tear strength are two other significant features of the flexible sheet. These features enable the flexible sheet to imitate a rigid wall through tension. Rigidity can generally be characterized by an amount of deflection of the surface under a perpendicular force. The present inventors have found that a deflection of approximately 1 mm or less is virtually imperceptible to a casual observer, and give the impression of rigidity to the observer. For a 300-lb person leaning against a 10-ft by 8-ft wall at approximately a 45-degree angle, a 1-mm deflection of the wall represents a tension of approximately 20 lbs. per square inch. Various embodiments of the example material described above, mass-loaded vinyl, have a tear strength of up to 30 pounds and a tensile strength of 900 lbs. per square inch for a 3-mm thick sheet. Thus, mass-loaded vinyl represents one high-quality example of a material for use as the flexible sheet.

Figure 7:
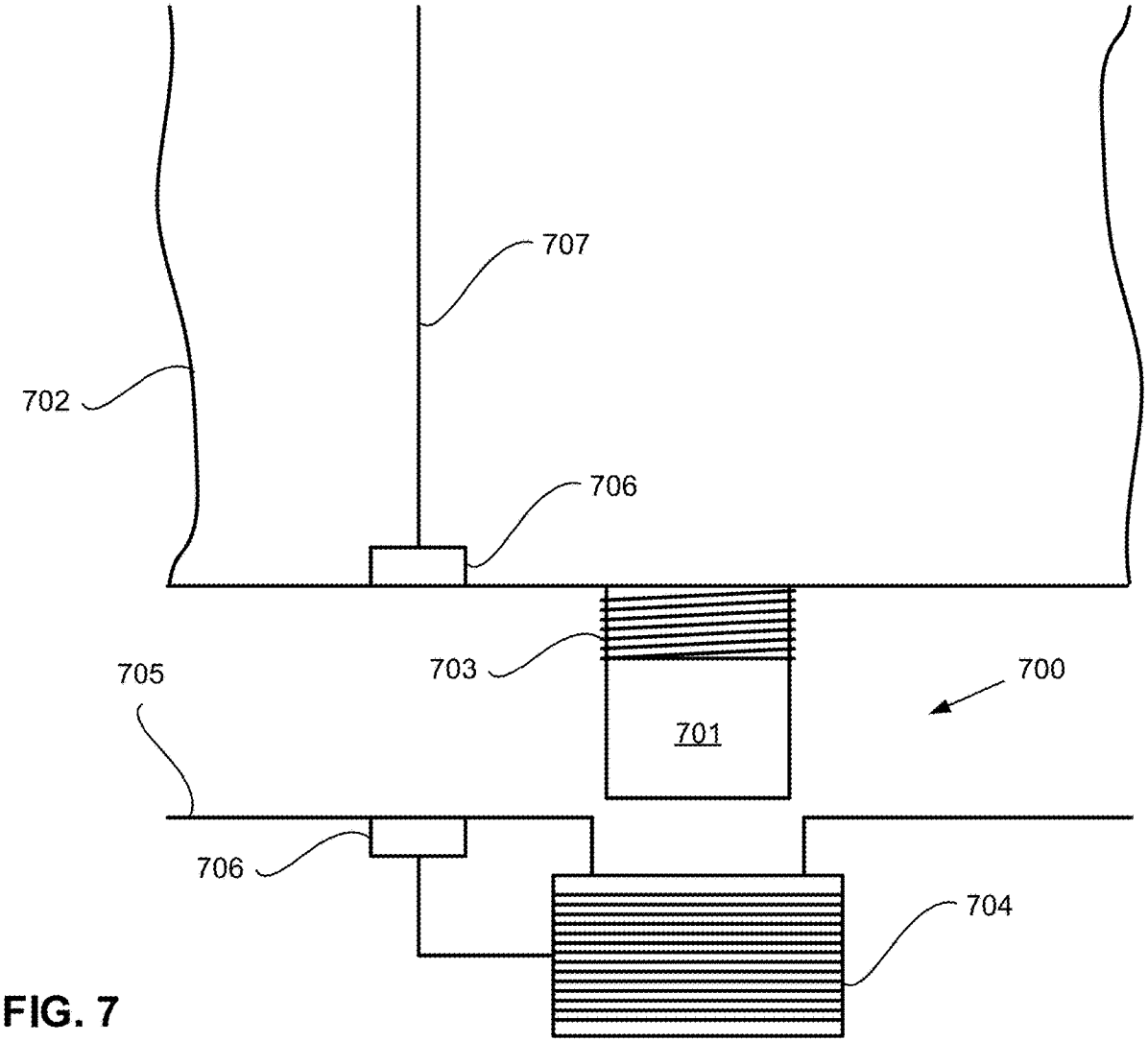
FIG. 7 depicts one embodiment of a sensor for determining when a flexible, roll-up panel has reached a surface below the panel.

FIG. 7 depicts one embodiment of a sensor for determining when a flexible, roll-up panel has reached a surface below the panel. Sensor 700 includes permanent magnet 701 vertically coupled to flexible panel 702 by spring 703, conductive coil 704 disposed in floor 705, electrical contacts 706, and conductive thread 707.

As the panel reaches the floor, the electrical contacts touch, and the permanent magnet extends into the coil. The change in movement of the permanent magnet causes it to oscillate up-and-down by the spring, inducing a current in the coil. The current is transmitted, via the conductive wire, to a controller that controls the unwinding of the panel. Upon receiving the signal from the coil, the controller stops unwinding the panel.

A variety of methods of operating the systems and mechanism described above are described below regarding FIGS. 8-11. Thus, reference is made generally to elements and features described above without specific restriction to the specifically described embodiments.

Figure 8:
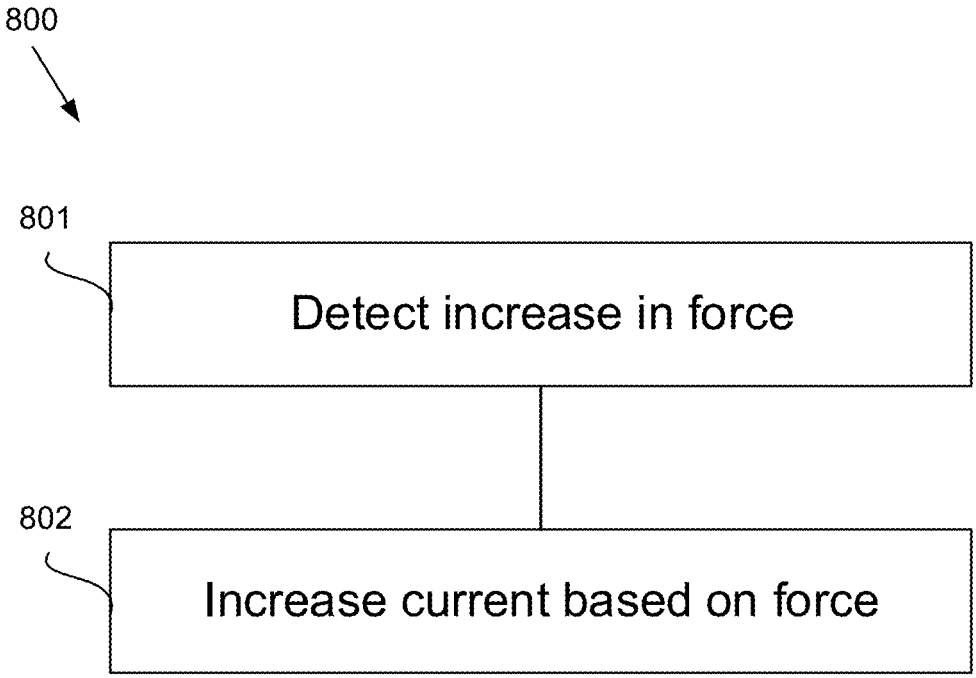
FIG. 8 depicts one method of operating a tensioning mechanism.

FIG. 8 depicts one method of operating a tensioning mechanism, the instructions for which are stored on a controller such as that described above regarding FIG. 2. Method 800 includes, at block 801, detecting an increase in a force exerted on the flexible sheet, and, at block 802, increasing an amount of current being delivered to the electromagnet. The increase in the current is proportional to, and based upon, the force exerted on the flexible sheet.

Figure 9:
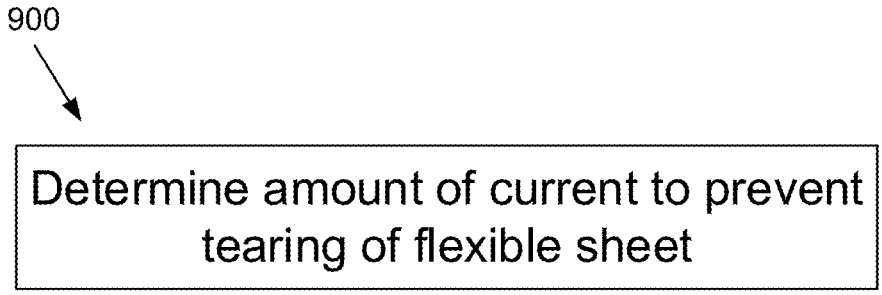
FIG. 9 depicts another method of operating a tensioning mechanism, either along, or in combination with the method of FIG. 8.

FIG. 9 depicts another method of operating a tensioning mechanism, either along, or in combination with the method of FIG. 8. Method 900 includes determining, based on data regarding an amount of tension required to tear the flexible sheet (stored in the hardware memory), an amount of current to deliver to the electromagnet such that a magnetic force exerted between the electromagnet and the at least one corresponding permanent magnet or ferromagnet is less than the amount of force required to tear the flexible sheet by an amount ranging from one one-hundredth of a percent to ten percent. In various other embodiments, this range is generally slightly below a margin of error associated with the force required to tear the flexible sheet.

Figure 10:
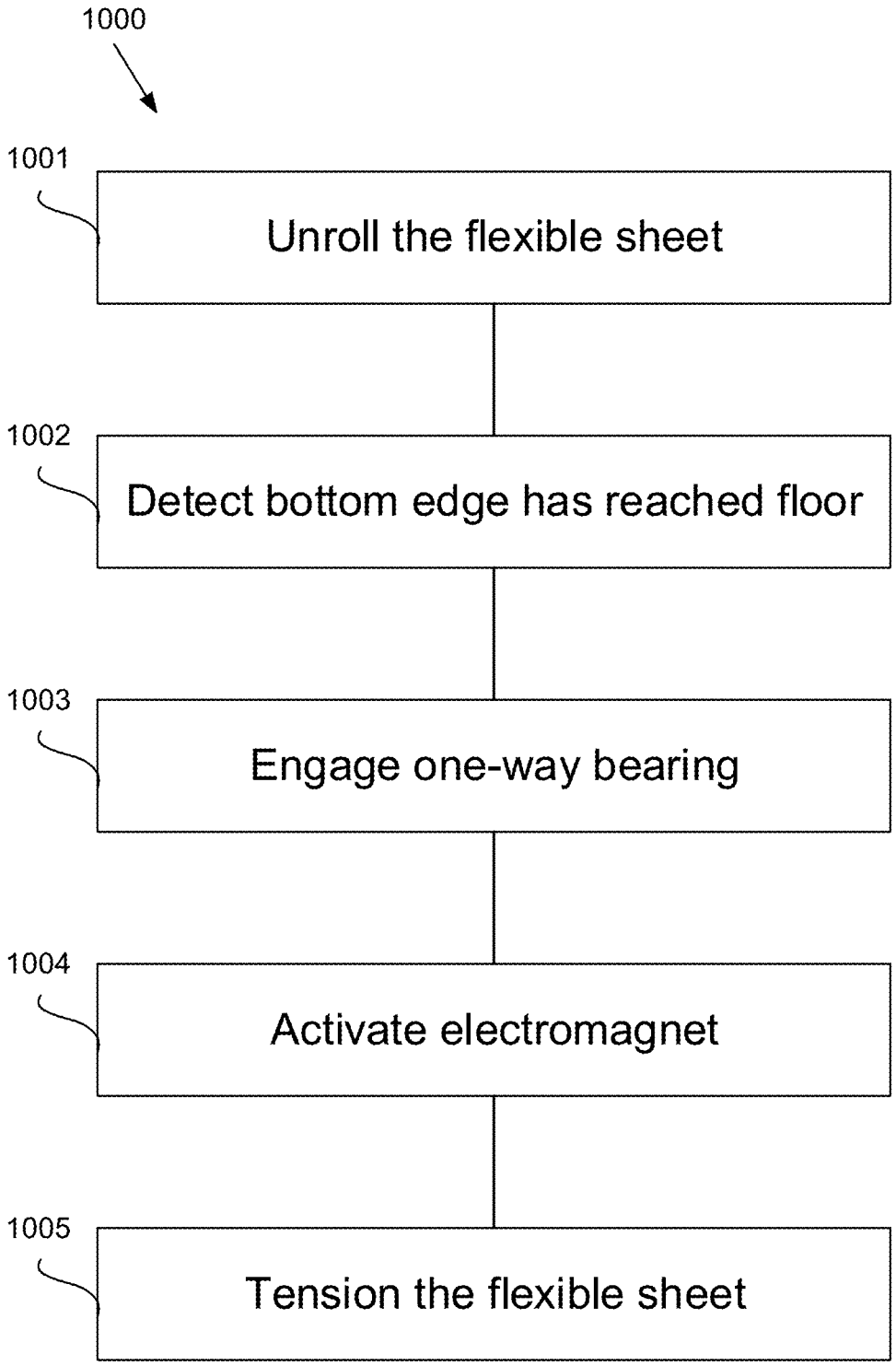
FIG. 10 depicts a method of tensioning a flexible, roll-up panel.

FIG. 10 depicts a method of tensioning a flexible, roll-up panel. Method 1000 includes, at block 1001, unrolling the flexible sheet from the drum; at block 1002, detecting a bottom edge of the flexible sheet at the second end has reached a surface beneath the flexible sheet; at block 1003, engaging the one-way bearing with the roller drum; at block 1004, activating the electromagnet; and, at block 1005, tensioning the flexible sheet. Tensioning the flexible sheet includes, in various embodiments, at least partially rewinding the flexible sheet as the sheet is fixed to the floor by the electromagnet.

Figure 11:
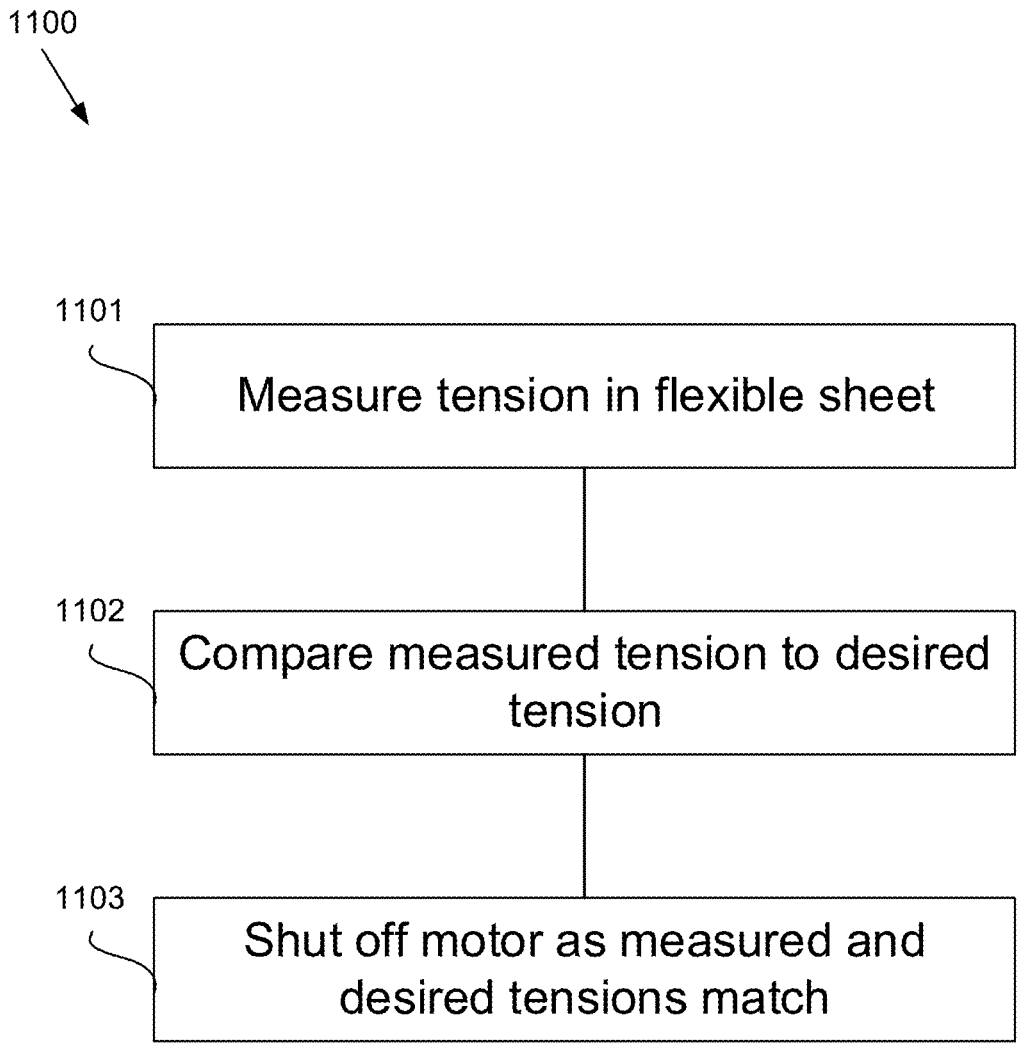
FIG. 11 depicts yet another method of tensioning a flexible, roll-up panel.

FIG. 11 depicts yet another method of tensioning a flexible, roll-up panel. Method 1100 includes, at block 1101, measuring an amount of tension in the flexible sheet; at block 1102, comparing the measured tension in the sheet to a desired tension; and, at block 1103, shutting off the motor as the measured tension matches the desired tension. The desired tension is stored in the hardware memory and accessed by the one or more processors.

We claim:

1. A flexible, roll-up wall, comprising:

a roller drum having a selectively engageable one-way bearing;

one or more power supplies;

a motor coupled to the drum by a transmission and electrically coupled to at least one of the one or more power supplies;

a flexible, sound-attenuating sheet having a base fabric and a polymer coating surrounding the base fabric, the sheet coupled to the roller drum at a first end of the sheet;

an electromagnet and at least one of a corresponding permanent magnet or ferromagnet;

one or more conductive threads woven into the base fabric extending from the first end of the flexible sheet to a second end of the flexible sheet, at least one of the one or more conductive threads electrically coupled to the electromagnet and at least one of the one or more power supplies;

a force meter; and a potentiometer electrically coupled between the at least one power source coupled to the electromagnet and the electromagnet, wherein the potentiometer varies the current delivered to the electromagnet based on a force measured by the force meter.

2. The roll-up wall of claim 1, wherein the force meter comprises a dynamometer.

3. The roll-up wall of claim 1, wherein the force meter comprises a load cell.

4. The roll-up wall of claim 1, wherein the force meter comprises a piezoelectric sensor.

5. The roll-up wall of claim 1, wherein the force meter is coupled to the motor.

6. The roll-up wall of claim 1, wherein the force meter is fixedly coupled to the electromagnet or the at least one corresponding permanent magnet or ferromagnet.

7. The roll-up wall of claim 1, wherein the force meter is fixedly coupled to the flexible sheet or an area of surface beneath the flexible sheet.

8. The roll-up wall of claim 1, wherein the electromagnet is coupled to the flexible sheet at the second end of the flexible sheet opposite the first end of the flexible sheet.

9. The roll-up wall of claim 1, wherein the at least one corresponding permanent magnet or ferromagnet is disposed in a surface beneath a bottom edge along the second end of the flexible sheet.

10. The roll-up wall of claim 1, wherein the at least one corresponding permanent magnet or ferromagnet is coupled to the flexible sheet at the second end of the flexible sheet opposite the first end of the flexible sheet.

11. The roll-up wall of claim 1, wherein the electromagnet is disposed in a surface beneath a bottom edge along the second end of the flexible sheet.

12. The roll-up wall of claim 1, further comprising:

a second permanent magnet vertically coupled to one or more springs at the second end of the flexible sheet; and a conductive coil disposed in a surface beneath the bottom edge of the flexible sheet aligned with the second magnet such that vertical oscillation of the second magnet induces a current in the coil.

13. The roll-up wall of claim 12, wherein the conductive coil is electrically coupled to at least one of the one or more conductive threads.

14. The roll-up wall of claim 12, wherein the second magnet extends beneath the bottom edge.

15. The roll-up wall of claim 12, wherein, as the bottom edge contacts the surface, the second magnet extends into the coil.

16. The roll-up wall of claim 1, further comprising a controller electrically coupled to one or more of the motor, the power supplies, the electromagnet, the force meter, and the potentiometer, wherein the controller comprises:

one or more hardware processors; and hardware memory having instructions stored thereon for operating one or more of the motor, the power supplies, the electromagnet, the force meter, and the potentiometer.

17. The roll-up wall of claim 16, wherein the instructions comprise:

detecting an increase in a force exerted on the flexible sheet; and increasing an amount of current being delivered to the electromagnet, wherein the increase in the current is proportional to, and based upon, the force exerted on the flexible sheet.

18. The roll-up wall of claim 16, wherein the instructions comprise:

unrolling the flexible sheet from the drum;

detecting a bottom edge of the flexible sheet at the second end has reached a surface beneath the flexible sheet;

engaging the one-way bearing with the roller drum;

activating the electromagnet; and tensioning the flexible sheet.

19. The roll-up wall of claim 18, wherein tensioning the flexible sheet comprises:

measuring an amount of tension in the flexible sheet;

comparing the measured tension in the sheet to a desired tension; and shutting off the motor as the measured tension matches the desired tension.

20. The roll-up wall of claim 16, wherein the memory stores data regarding an amount of tension required to tear the flexible sheet, and wherein the instructions comprise:

determining, based on the data, an amount of current to deliver to the electromagnet such that a magnetic force exerted between the electromagnet and the at least one corresponding permanent magnet or ferromagnet is less than the amount of force required to tear the flexible sheet by an amount ranging from one one-hundredth of a percent to ten percent.

* * * * *